US006150984A

United States Patent [19]

Suguro et al.

[11] Patent Number: 6,150,984

[45] Date of Patent: Nov. 21, 2000

[54] SHARED ANTENNA AND PORTABLE RADIO DEVICE USING THE SAME

[75] Inventors: Akihiro Suguro; Shinichi Nakada; Tooru Obata, all of Yokohama, Japan

[73] Assignee: Kyocera Corporation, Kyoto, Japan

[21] Appl. No.: 08/984,411

[22] Filed: Dec. 3, 1997

[30] Foreign Application Priority Data

Dec. 4, 1996 [JP] Japan ..... 8-324194

[51] Int. Cl.[7] ..... H01Q 1/36

[52] U.S. Cl. ..... 343/702; 343/700 MS; 343/895

[58] Field of Search ..... 343/700 MS, 702, 343/725, 794, 895, 729, 749, 751

[56] References Cited

U.S. PATENT DOCUMENTS

| | | | |
|---|---|---|---|
| 5,220,334 | 6/1993 | Raguenet et al. | 343/700 MS |
| 5,592,184 | 1/1997 | Cassel et al. | 343/752 |
| 5,650,792 | 7/1997 | Moore et al. | 343/725 |

FOREIGN PATENT DOCUMENTS

| | | |
|---|---|---|
| 0 523 867 | 1/1993 | European Pat. Off. . |
| 0 590 955 | 4/1994 | European Pat. Off. . |
| 09 219 621 | 8/1997 | Japan . |
| 2 272 575 | 5/1994 | United Kingdom . |
| WO 94/17565 | 8/1994 | WIPO . |

*Primary Examiner*—Don Wong
*Assistant Examiner*—James Clinger
*Attorney, Agent, or Firm*—Hogan & Hartson, LLP

[57] ABSTRACT

A shared antenna in that a linear antenna is electrically connected to the upper end of a power pin of a microstrip plane antenna via a capacitive element. The shared antenna is used in both satellite communications and ground communications and can be used without a need of mechanical switching of the antenna. Further, crimped radiating elements having spatial expansion are electrically connected to the vicinity of the upper end of a feed pin of a microstrip plane antenna via a capacitive element, thereby realizing superior impedance matching and radiation patterns of the shared antenna.

8 Claims, 13 Drawing Sheets

"F1"
"F2"
"F3"
"F4"
"F5"

F1=1.621GHz
max1=-45.67dBm

F2=.81GHz
max2=-41.05dBm

F3=.83GHz
max3=-41.04dBm

F4=.94GHz
max4=-39.12dBm

F5=.96GHz
max5=-38.28dBm

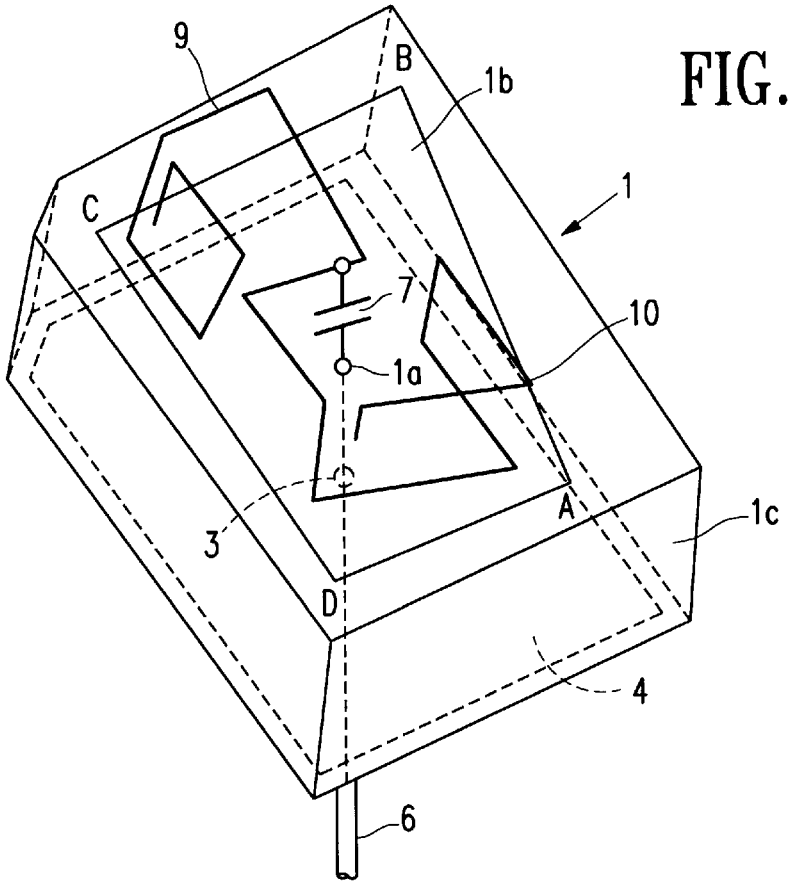
FIG. 6A
FIG. 6B
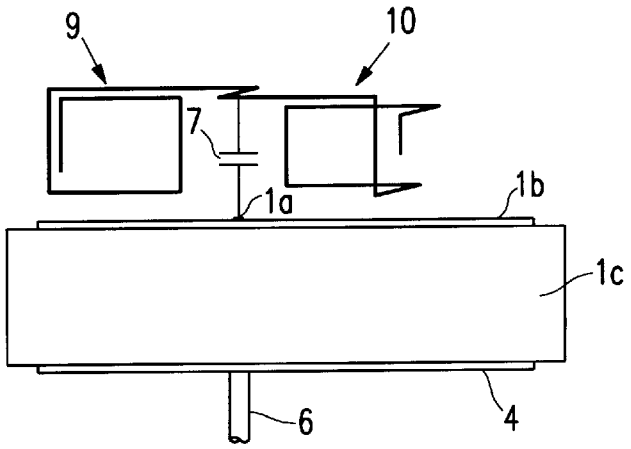

"F1"
"F2"
"F3"
"F4"
"F5"

F1 =.898GHz
max1=-36.76dBm

F2 =.96GHz
max2=-36.85dBm

F3 =1.621GHz
max3=-47.54dBm

F4 =1.651GHz
max4=-45.35dBm

F5 =1.689GHz
max5=-42.38dBm

"F1" F1=.898GHz max1=-35.92dBm

"F2" F2=.96GHz max2=-36.09dBm

"F3" F3=1.621GHz max3=-43.93dBm

"F4" F4=1.651GHz max4=-44.83dBm

"F5" F5=1.689GHz max5=-47.57dBm

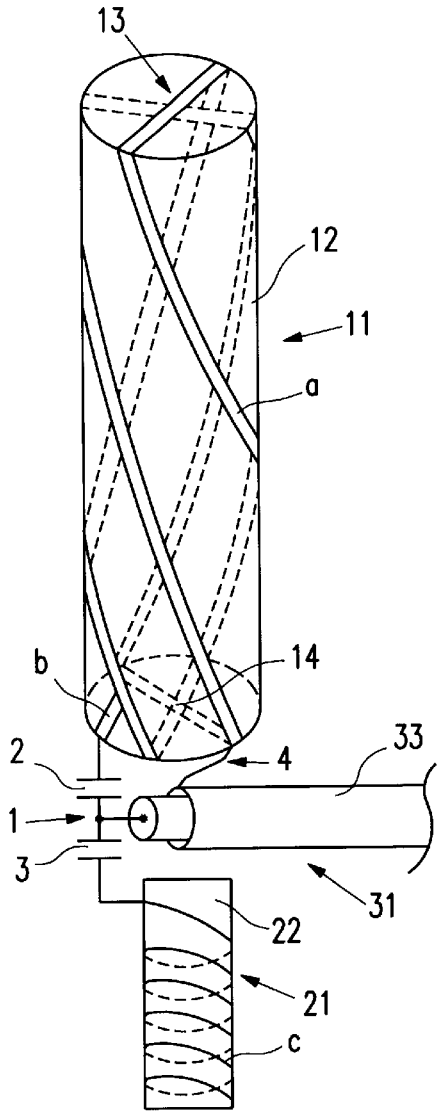
FIG. 12
FIG. 13
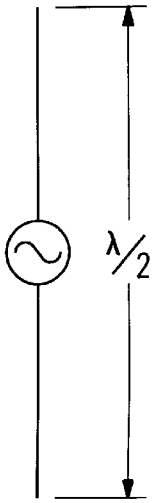

"F1"
"F2"
"F3"
"F4"
"F5"

F1=1.621GHz
max1=-46.10dBm
F2=.81GHz
max2=-44.57dBm
F3=.83GHz
max3=-44.01dBm
F4=.94GHz
max4=-38.06dBm
F5=.96GHz
max5=-38.06dBm

SHARED ANTENNA AND PORTABLE RADIO DEVICE USING THE SAME

BACKGROUND OF THE INVENTION

The present invention relates to the field of communications, and more particularly, to an antenna for use in portable radio communications utilizing a satellite and in portable radio communications established between ground radio stations. Further, the present invention relates to a portable radio using the antenna.

In recent years, the conception of a portable telephone using a satellite has been proposed. A frequency band of 1.6 GHz is assigned to communications from a ground portable telephone to a satellite, and a frequency band of 2.4 GHz is assigned to communications from a satellite to a ground portable telephone. The frequency band of 1.6 GHz is also assigned to bidirectional communications between the ground and a satellite.

Frequency bands of 800 MHz, 1.5 GHz, and 1.9 GHz have already been assigned to ground communications. With regard to a shared antenna used for both satellite communications and ground communications, it has been proposed a method of feeding power to the upper end of a two-wire helical antenna which uses a coaxial line and lead wires (Unexamined Japanese Patent Publication 9-219621).

SUMMARY OF THE INVENTION

The object of the present invention is to provide an antenna which can be used for both satellite communications and ground communications and a portable radio (or portable telephone) which enables both satellite communications and ground communications.

According to the present invention, an integrated antenna is used in both satellite communications and ground communications without the need of mechanical action, by attaching a linear radiating element via a capacitive element to the front end of a feed pin which supplies a high-frequency current to a microstrip plane antenna.

A shared antenna according to the present invention comprises a microstrip plane antenna 1 (hereinafter simply referred to as an MSA), a capacitive element 7, and a linear radiating element 8.

Further, it is an object of the present invention to simultaneously satisfy impedance matching, an antenna gain, and radiation patterns at a desired frequency.

To achieve the object, according to the present invention, crimped radiating elements having spatial expansion are added via a capacitive element to the vicinity of the front end of a feed pin which supplies a high-frequency current to a microstrip plane antenna.

Moreover, in accordance with the present invention, a parallel feed is supplied to a four-wire helical antenna (i.e., a circularly-polarized antenna), and a series feed is supplied to a linear antenna or a single-line helical antenna (i.e., a linearly-polarized antenna). In order to prevent these two antennas from interfering with each other, capacitive elements, such as capacitors, are provided between the antennas and a feed point so as to control the flow of a high-frequency current. The antennas are positioned so as to be coaxially aligned with each other, thereby preventing interference between the antennas and maintaining the directivity of the antennas. The circularly-polarized antenna is operated at a frequency band of 1.6 GHz, and the linear antenna is operated at a frequency band of 800 to 900 MHz. Particularly, the linearly-polarized antenna shows superior characteristics such as those of the half-wavelength vertical dipole antenna (shown-in FIG. 13) in cooperation with the circularly-polarized antenna.

BRIEF DESCRIPTION OF THE DRAWINGS

FIG. 6A is a perspective view showing a shared antenna according to second embodiment of the present invention;

FIG. 6B is a side view showing the same;

FIG. 11B shows a radiation pattern in which a direction of 0 degree corresponds to the direction of an upper left of the antenna shown in FIG. 7 and a direction of 180 degrees correspond to the direction of a lower right of the antenna shown in FIG. 7;

FIG. 12 is a schematic representation showing the configuration of an antenna according to third embodiment of the present invention;

FIG. 13 is a diagrammatic representation showing a half wavelength dipole antenna.

DETAILED DESCRIPTION OF THE PREFERRED EMBODIMENTS

First Embodiment

Figure 1:
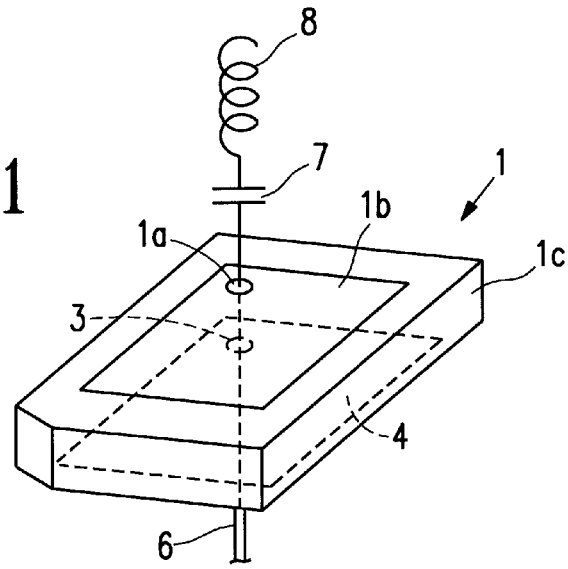
FIG. 1 is a schematic view showing a shared antenna according to first embodiment of the present invention.

FIG. 1 is a schematic representation showing the configuration of a shared antenna according to the present invention.

In the drawing, reference numeral 1 designates a microstrip plane antenna (MSA); 1*a* a feed pin; 1*b* a patch-shaped radiating element; 1*c* a dielectric substrate; 4 a ground conductor (conductor plate); 7 a capacitive element; and 8 a linear radiating element.

Figure 2:
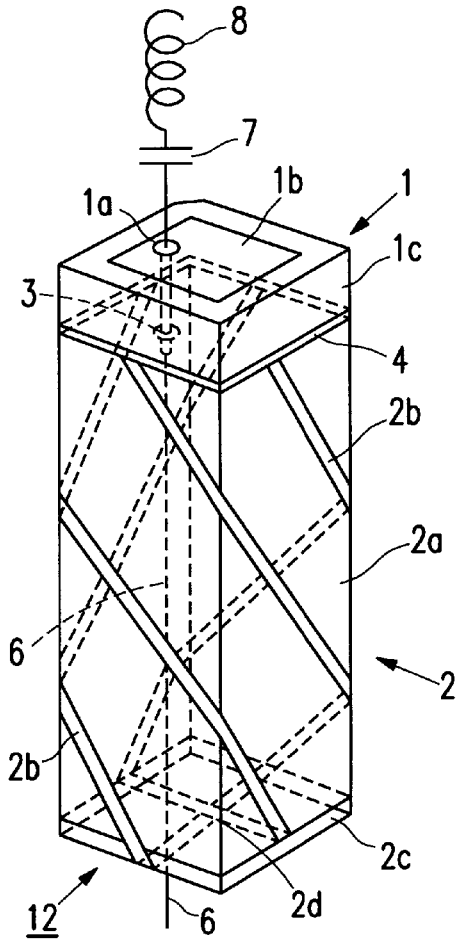
FIG. 2 is a schematic view showing a composite antenna formed by connection of a helical antenna to the lower end of the shared antenna.

The MSA 1 operates as a circularly-polarized antenna at the first frequency by appropriate designing of the dielectric constant or dimension of a dielectric substrate 1*c*; a parameter of the dielectric substance such as thickness; the dimension of the patch-shaped radiating element 1*b* labeled to the dielectric substrate 1*c*; or the position of the feed pin 1*a*. As shown in FIG. 2, the linear radiating element 8 operates at the second frequency as a grounded quarter-wave linearly-polarized antenna by means of a helical antenna positioned below the ground conductor 4.

An explanation will now be given of a case where the MSA 1 operates as a circularly-polarized antenna. For example, a patch-shaped radiating element 1*b* is attached to the dielectric substrate 1*c*, thereby constituting a single-point back feed MSA 1. Taking a longer side of the MSA 1 as A and a shorter side of the same as B, the MSA 1 is formed so as to obtain 100×A/B=102 to 103% or thereabouts. At this time, the longer side A oscillates at a comparatively low frequency, to thereby exhibit elliptically polarized characteristics. The shorter side B oscillates at a comparatively high frequency, to thereby exhibit elliptically polarized characteristics orthogonal to the foregoing elliptically polarized characteristics. The MSA 1 operates at a frequency between these elliptically polarized characteristics as a circularly-polarized antenna.

To connect a feed line 6 to the feed pin 1*a*, impedance matching is ensured by adjusting the position of the feed pin 1*a*. More specifically, it is essential that the feed pin 1*a* be positioned at an intersection of diagonal lines of the MSA 1 in such a way as to obtain 100×(A−B)/A=30% or thereabouts.

Next, an explanation will be given of the coupling between the MSA 1 and the linear radiating element 8. The capacitive element 7, such as a capacitor, is connected to the upper end of the power feed pin 1*a* of the MSA 1. The linear radiating element 8, such as a helical antenna, is connected to the top of the capacitive element 7. By means of the capacitive element 7, there is reduced interference between the circularly-polarized antenna which operates at the first frequency and the linearly-polarized antenna which operates at the second frequency. Particularly, a radiation pattern of the circularly-polarized wave is improved.

FIG. 2 shows an example of a composite antenna 12 which is formed by combination of a composite antenna proposed by the applicant of the present patent application (Japanese Patent Application 8-196038) and the shared antenna shown in FIG. 1. A helical antenna 2 positioned below the MSA 1 comprises linear radiating elements 2*b* which are electrically connected to the ground conductor 4 of the MSA 1 and receive power. The helical antenna 2 of the present example is formed into a four-wire helical antenna as a representative example of the helical antenna. In FIG. 2, the elements which are the same as those shown in FIG. 1 are assigned the same reference numerals. Reference numeral 2*a* designates a dielectric column (a dielectric columnar support) around which the linear radiating elements 2*b* are wrapped. Reference numeral 2*c* is an insulating substance which is interposed between the linear radiating elements 2*b* so as to prevent direct contact at an intersection of the linear radiating elements 2*b* at the lower end of the helical antenna 2. Reference numeral 2*d* is an intersection where the linear radiating elements 2*b* cross each other without a physical contact by means of the presence of the insulating substance 2*c*. Reference numeral 3 designates a feed point common to the MSA 1 and the helical antenna 2. The feed pin 1*a* is connected to a feed line (a coaxial line) 6 which passes through the dielectric substrate 1*c* and keeps out of contact with holes formed in the ground conductor 4. The linear antenna 8 is electrically connected to the upper end of the feed line 6 via the capacitive element 7.

Figure 3:
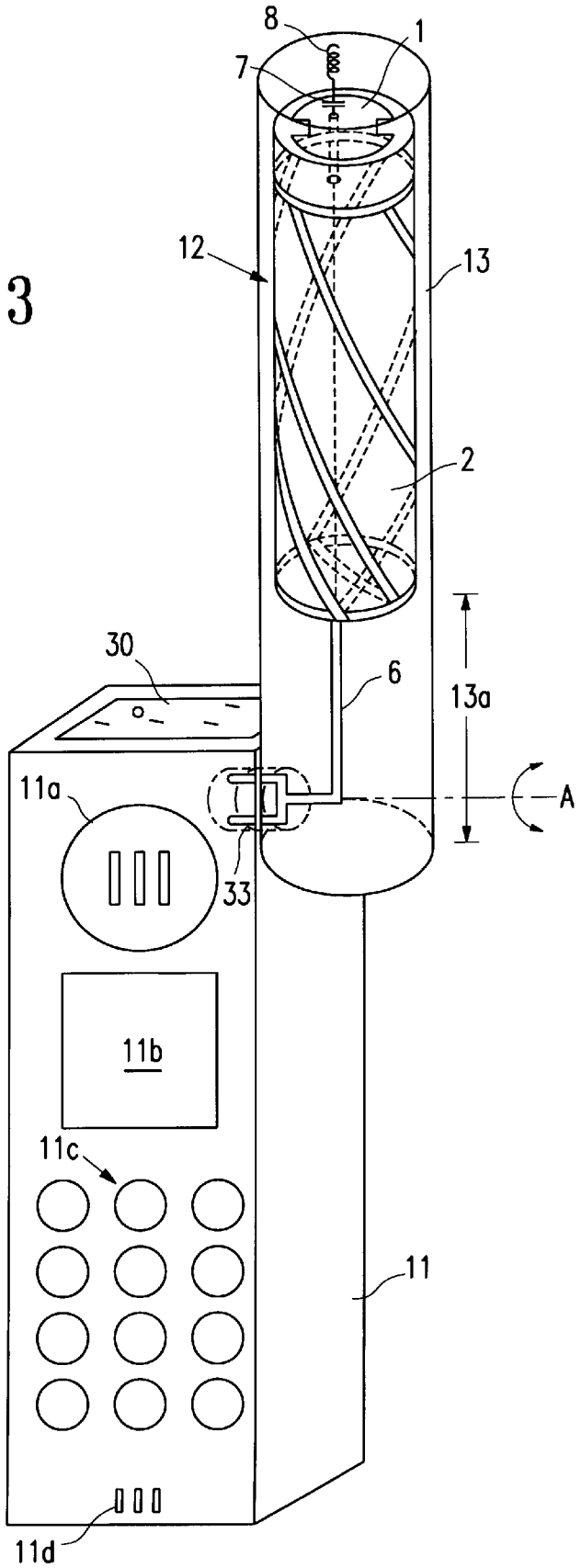
FIG. 3 is a general view showing an example of a portable radio which has the composite antenna shown in FIG. 2 formed into a rod shape.
Figure 4:
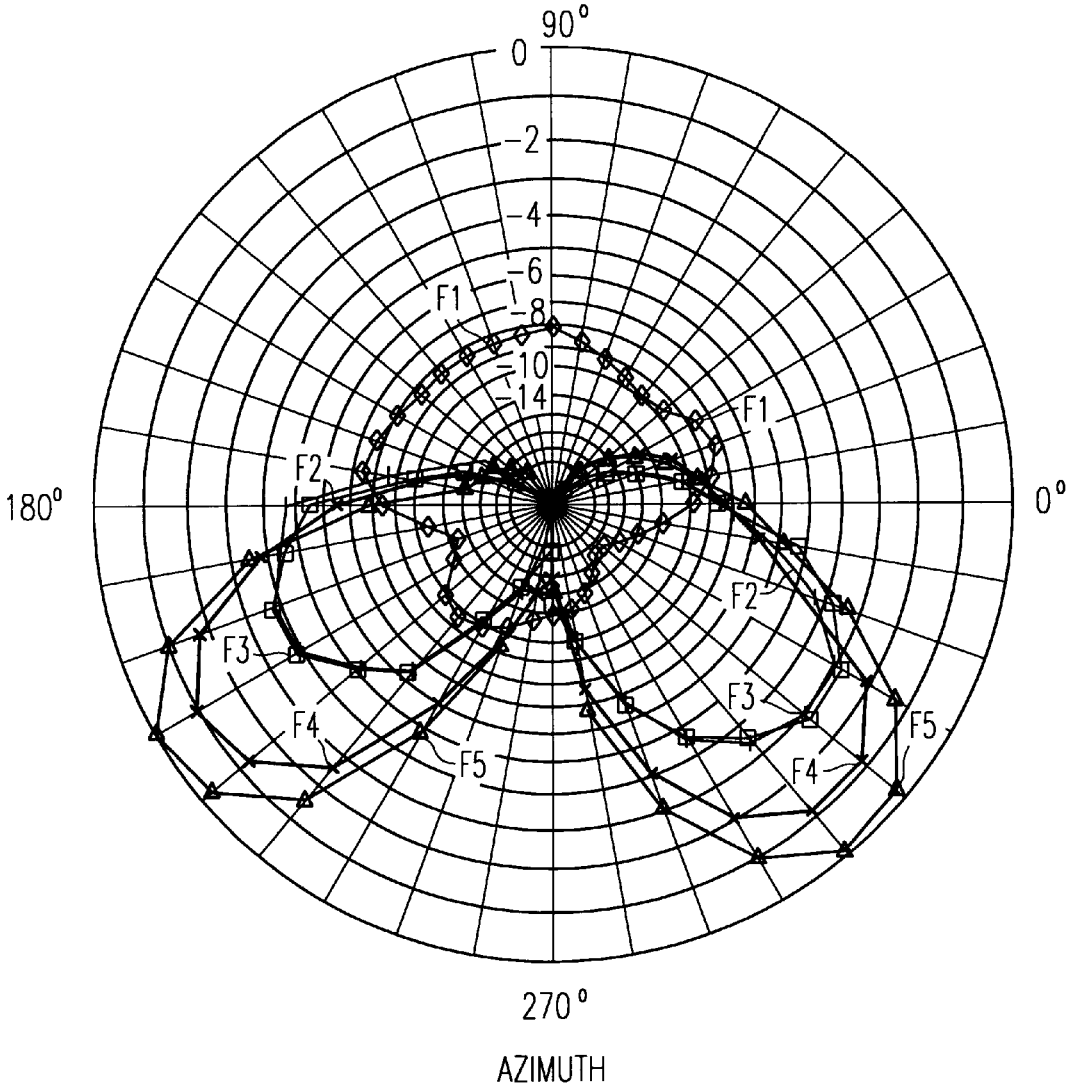
FIG. 4 is a plot showing the result of measurement of patterns radiated from the antenna shown in FIG. 3 at a satellite communications frequency and a frequency band of ground portable telecommunications.
Figure 5:
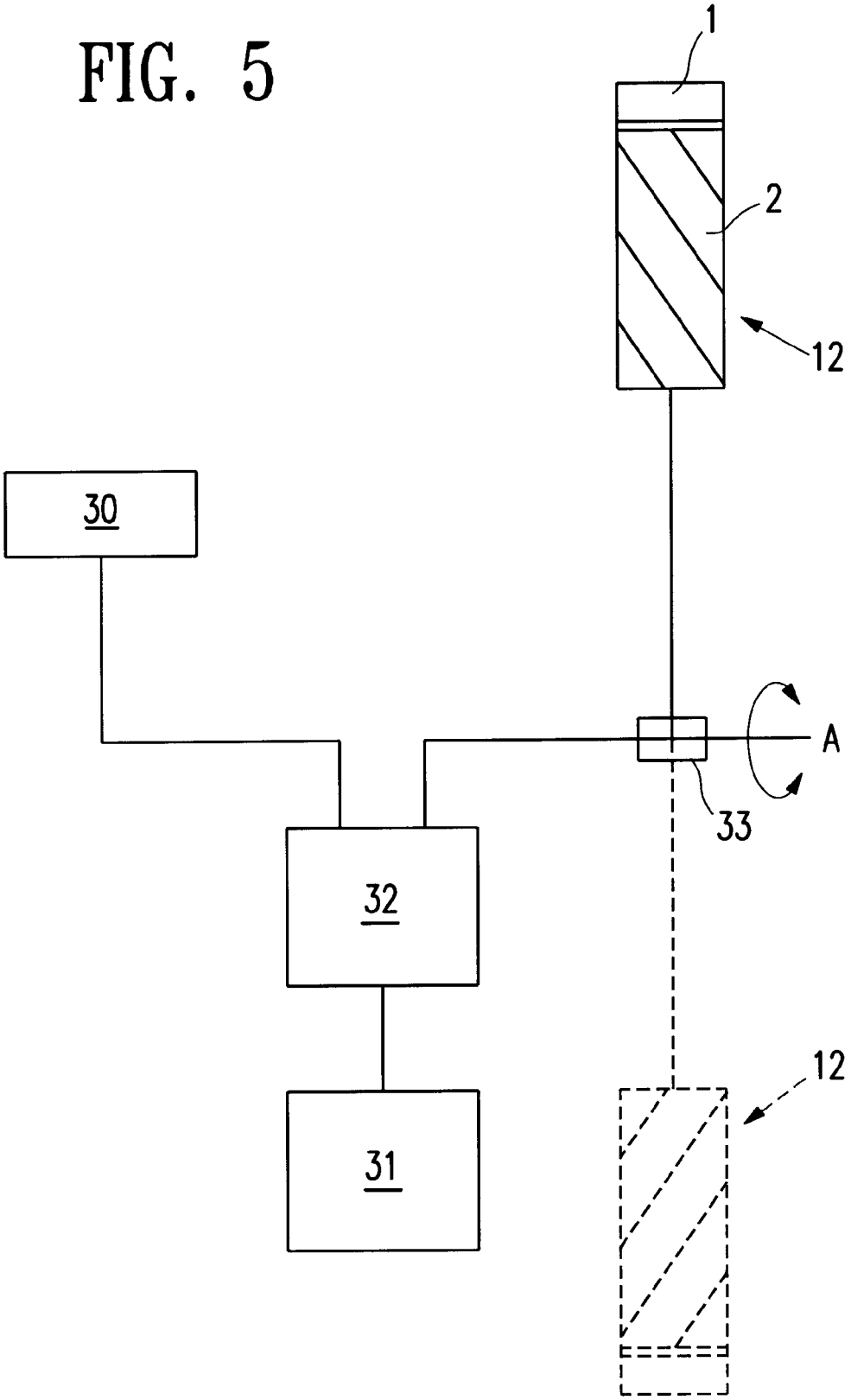
FIG. 5 is a block diagram showing the circuitry of the antenna of the portable radio shown in FIG. 3.

FIG. 3 shows an example of the composite antenna 12 shown in FIG. 2 which is formed into a rod and is attached to a portable radio 11. FIG. 4 shows the result of measurement of radiation patterns of the composite antenna 12 which are formed over the longitudinal cross-section of the composite antenna 12 at the frequency bands of 1.6 GHz and 800 MHz with a configuration equivalent to that shown in FIG. 2. Patterns radiated in lower right and left directions are radiated at a frequency band of 800 MHz. The pattern principally radiated in an upward direction is radiated at a frequency band of 1.6 GHz. In FIG. 3, the elements which are the same as those shown in FIG. 2 are assigned the same reference numerals. The composite antenna 12 is sheathed with an antenna holding cylinder 13 and is configured so as to rotate around a rotary shaft A. When the portable radio 11 is waiting for an incoming call, the composite antenna 12 can be collapsed toward a casing of the portable radio 11. A built-in microstrip plane antenna (MSA) 30 is provided on the inside of an upper surface of the casing of the portable radio 11. A diversity antenna is formed by means of the MSA 30 and the composite antenna 12 in combination. The MSA 30 has a gain in a right-bank (or left-bank) circularly-polarized mode which is the same as that of the composite antenna 12 primarily in the zenith. The diversity antenna comprises the composite antenna 12 shown in FIG. 5, the MSA 30, a radio section 31, and signal composition means (or signal selection means) 32 including the composite antenna 12 and the MSA 30. In FIG. 3, the composite antenna 12 is retained by the antenna retaining cylinder 13 and is positioned in an elevated position spaced from the casing of the portable radio 11 by only the length of the connection section 13*a*, thereby preventing a gain loss of the radio at a low elevation angle which would otherwise caused by the head of the user during a call. A call is made while the composite antenna 12 is in an upright position as shown in FIG. 3, and communications is established by means of a given right-bank (or left-bank) circularly-polarized wave. When the radio 11 is in a wait state, the composite antenna 12 is rotated to and is brought into close contact with the side surface of the casing of the portable radio 11. A rotary connector 33 rotates the composite antenna 12 with regard to the casing of the portable radio 11. A dotted line shown in FIG. 5 indicates a collapsed state of the composite antenna 12 as a result of rotation. In the collapsed state, the composite antenna 12 is oriented in the direction opposite to the direction of the same when the radio 11 is used, so that the direction of rotation of the circularly-polarized wave becomes reversed. Accordingly, the sensitivity of the composite antenna 12 is considerably deteriorated, and the MSA 30 principally operates while the radio 11 is in a wait state. FIG. 4 is a diagram showing the result of measurement of patterns radiated from the antenna shown in FIG. 3 at a satellite communications frequency and a frequency band of ground portable telecommunications;

According to the first embodiment of the present invention, a portable radio can cope with a plurality of radio communications services without mechanical switching action, by addition of a linear radiating element via a capacitive element to the front end of a feed pin which supplies a high-frequency current to a microstrip plane antenna. Since there is not required a need of mechanical switching action, the reliability of the antenna and the radio main body is improved.

Second Embodiment

With reference to the accompanying drawings, a shared antenna according to second embodiment of the present invention will be described. FIGS. 6 through 11 relate to the second embodiment of the present invention. In the drawings, the elements which are the same as those of the existing antenna are assigned the same reference numerals. As a result, there will be omitted an explanation of the elements which are the same as those of the existing antenna.

FIGS. 6A and 6B show the outline of configuration of the shared antenna according to the present invention. The shared antenna comprises a microstrip plane antenna 1 (hereinafter simply referred to as a MSA), a capacitive element 7, and crimped radiating elements 9, 10 having spatial expansion. FIG. 6A is a perspective view showing the shared antenna according to one embodiment of the present invention. FIG. 6B is a side view showing the shared antenna shown in FIG. 6A. The microstrip plane antenna (MSA) 1 comprises a feed pin 1*a*, a patch-shaped radiating element 1*b*, a dielectric substrate 1*c*, and a ground conductor (conductor plate) 4 provided on the reverse side (or the other side) of the dielectric substrate 1*c*. The capacitive element 7 is connected to the vicinity of the upper end of the feed pin 1*a*. The first crimped radiating element 9 is connected to the power feed pin 1*a* via the capacitive element 7. Similarly, the second crimped radiating element 10 is connected to the feed pin 1*a* via the capacitive element 7. For reasons which will be described later, the first and second crimped radiating elements 9, 10 are collapsed several times in horizontal and vertical directions in relation to the upper end of the capacitive element 7. As a result, the first and second crimped radiating elements 9, 10 are extended above the MSA 1.

The MSA 1 operates as a circularly-polarized antenna at the first frequency f1 by appropriate designing of the dielectric constant or dimension of a dielectric substrate 1*c*; a parameter of the dielectric substance such as thickness; the dimension of the patch-shaped radiating element 1*b* labeled to the upper surface of the dielectric substrate 1*c*; or the position of the feed pin 1*a*. In the MSA 1, it is formed the patch-shaped conductor in that at least three sides of a quadrangle (ABCD) are different in length from each other. By virtue of the profile of the patch-shaped conductor, multiple resonance required to generate a circularly-polarized wave and impedance matching used for efficiently transmitting/receiving an electronic wave are readily accomplished. As a matter of course, it goes without saying that an MSA using an existing rectangular-patch-shaped radiating element may be used for the shared antenna.

Figure 7:
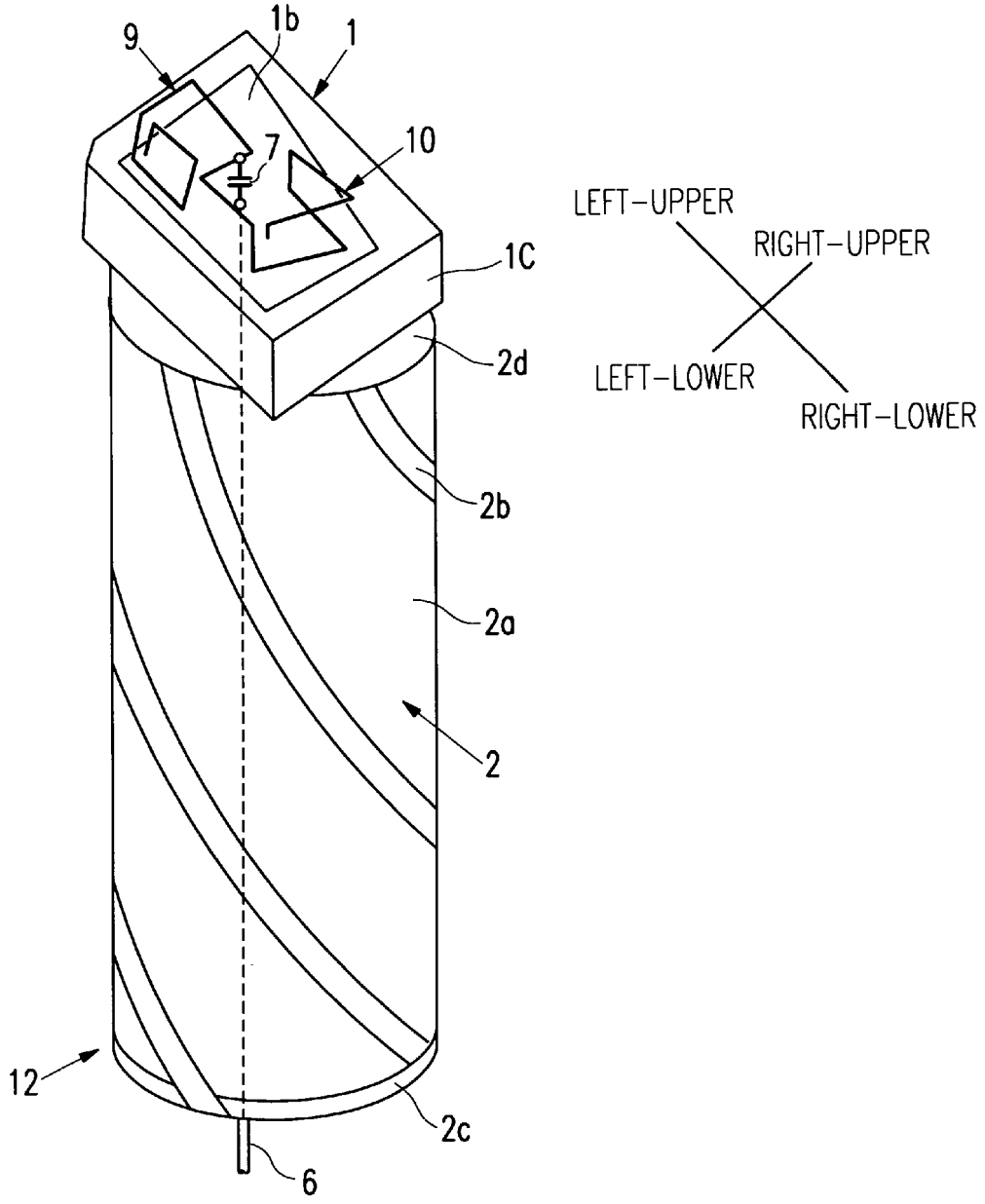
FIG. 7 is a perspective view showing a composite shared antenna according to the second embodiment while a helical antenna is connected to a lower portion of the shared antenna.

FIG. 7 shows the composite type shared antenna 12 which is formed by combination of the antenna described in Japanese Patent Application 8-196038 and the shared antenna shown in FIG. 6 and has gain in all directions. In the composite shared antenna 12 shown in FIG. 7, the first crimped radiating element 9 operates as a quarter-wavelength (¼λ) grounded antenna which oscillates at a second frequency f2 in cooperation with the helical antenna 2 positioned below the MSA 1 (or electrically connected to the base conductor 4). Similarly, the second crimped radiation 10 operates as a quarter-wavelength (¼λ) grounded antenna which oscillates at a third frequency f3 in cooperation with the helical antenna 2. The helical antenna 2 is the same as the existing helical antenna mentioned previously. With the foregoing configuration, a circularly-polarized antenna (which operates at the frequency f1) is formed from the MSA 1 and the helical antenna 2, whereas a linearly-polarized antenna (which operates at the frequency f2) is formed from the helical antenna 2 and the first crimped radiating element 9. Further, a linearly-polarized antenna (which operates at the frequency f3) is formed from the helical antenna 2 and the second crimped radiating element 10.

Specifications for the shared antenna manufactured in compliance with the embodiment of the foregoing embodiment are as follows:

The dielectric substrate 1*c* of the MSA 1 shown in FIG. 6 has a size of 28 mm square, a thickness of 12 mm, and a dielectric constant of about 20. The patch-shaped radiating element 1*b* of the MSA 1 has four sides; side A-B measures 20.0 mm, side B-C measures 19.0 mm, side C-D measures 18.3 mm, and D-A measures 16.7 mm. In a case where the antenna shown in FIG. 7 is formed from the antenna shown in FIG. 6, the center frequency of the multi-resonance is 1.651 GHz. The first crimped linear radiating element 9 of the linearly-polarized antenna comprises eight sides. The sides respectively measure 3, 14, 12, 10, 17, 10, 16, and 11 mm in that order from the upper end of the capacitive element 7. The total length of the sides is 93 mm. The second crimped linear radiating element of the linearly-polarized antenna comprises nine sides. The sides respectively measure 5, 11, 10, 12, 10, 10, 12, 13, 4 mm in that order from the upper end of the capacitive element 7. The total length of the sides is 87 mm. The capacitance of the capacitive element 7 is several picofarads. The length of the capacitive element including a lead wire is 12 mm. The capacitive element 7 contributes to matching of the impedance of the linearly-polarized antenna and to mitigation of interference between the linearly-polarized antenna and the circularly-polarized antenna. The first crimped radiating element 9 and the second crimped radiating element 10 are spaced apart at about 2 mm from the MSA 1.

The first resonance frequency is 898 MHz, and a voltage standing wave ratio (VSWR) at this frequency is 2.4. The second resonance frequency is 960 MHz, and VSWR at the frequency is 2.1. The peak gain of the antenna is −2 to −3 dBd referred to a ratio of the (half-wavelength) reference dipole and in a practical level.

Provided that light travels at a speed of 300,000 km/s in a vacuum, the resonance frequency f2 of the first crimped radiating element 9 can be determined to be 806 MHz by calculation, and the resonance frequency f3 of the second crimped radiating element 10 can be determined to be 862 MHz by calculation. The results of measurement of these frequencies are 898 MHz and 960 MHz, both of which are each greater than the calculated values by about 100 MHz. It is thought that the difference between the measured values and the calculated values is attributable to the capacitive element 7 or the profile of the crimped radiating element. However, the difference between the resonance frequencies f2 and f3 is about 60 MHz in both the case of the calculated values and the case of the measured values, thereby showing very superior correlation between the resonance frequencies. The radiating element is crimped to a profile such as that shown in FIG. 6 because of a desire to maintain the omnidirection characteristics of the vertically-polarized wave in two frequency bands which are separated away from each other while impedance match is ensured and to miniaturize the antenna. A received frequency of PDC 800 (one type of cellular phone for use at a band of 800 MHz in Japan) ranges 810 to 830 MHz. In contrast, the transmitted frequency of the same ranges from 940 MHz to 960 MHz. The adjustment of the resonance frequencies f2 and f3 and an improvement in the VSWR can be realized by optimization of the crimped radiating elements. The specifications for the helical antenna 2 positioned below the ground conductor 4 of the MSA1 are as follows: The cylinder (dielectric pole) 2*a* is formed from acrylic resin (having a thickness of 2 mm) having a diameter of 30 mm. Four copper foil taps (i.e., the linear radiating elements 2*b*), each of which has a width of 4.5 mm, are helically wrapped around the surface of the cylinder 2*a* over a length of 133 mm through 180 degrees. The copper foil tapes 2*b* are electrically connected to each other by means of sheathed lead wires at the lower end of the cylinder 2*a* while the insulating substance 2*c* is sandwiched between the copper foil tapes 2*b*. The sheathed lead wires crossed each other at the lower end of the cylinder 2*a* are not d.c.-coupled. The copper foil tapes serving as the helical radiating elements 2*b* are not directly connected to the ground conductor 4. The copper foil tapes and the ground conductor 4 are electrically connected together via a marginal section 2*d* (conductor) having a width of about 8 mm. The feed line 6 (i.e., a coaxial line) is led to a through hole (not shown) formed in the ground conductor 4 by way of the inside of the cylinder 2. The center conductor of the feed line 6 is connected to the feed pin 1*a* and feeds power to the patch-shaped radiating element 1*b*. The external conductor of the feed line 6 is connected to the ground conductor 4. In the embodiment, the gain of the circularly-polarized antenna at a low elevation angle (the first frequency=a band of 1.6 GHz) is improved when compared with the gain obtained solely by means of the MSA 1. The antenna has directivity in all directions from a low elevation angle to the zenith. The axial ratio of the antenna can be suppressed to as low as 3 dB or thereabouts.

Figure 8:
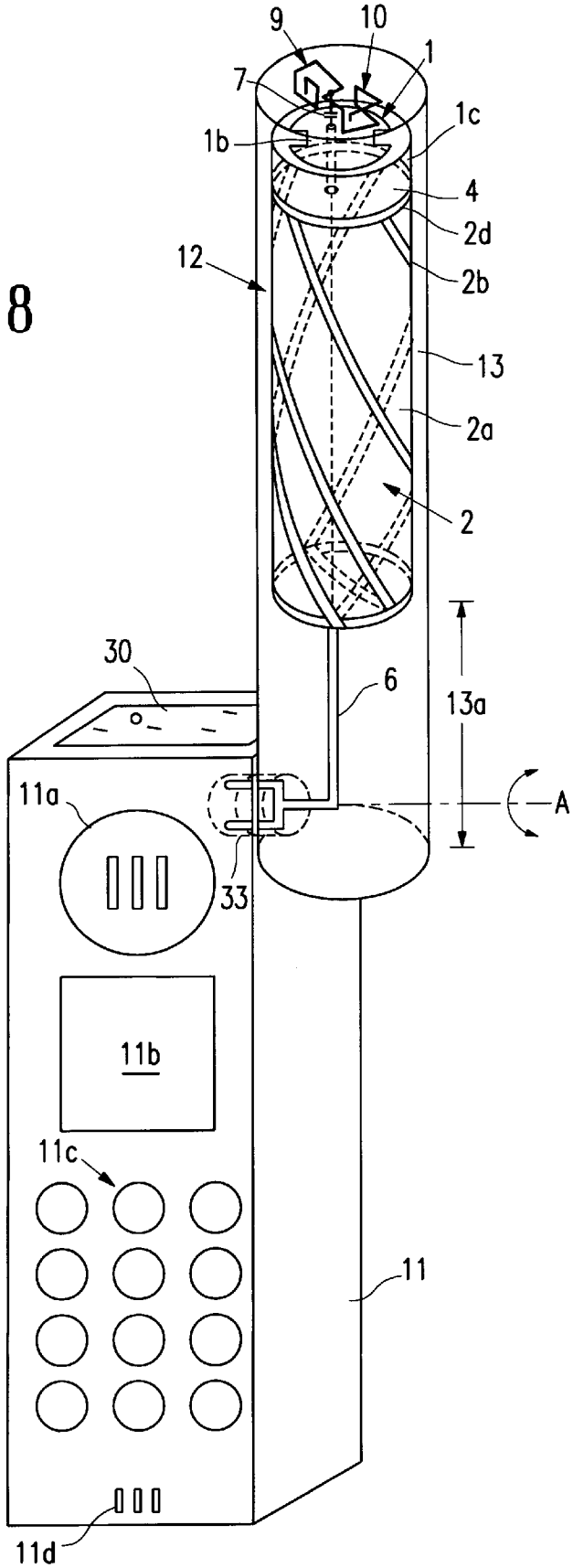
FIG. 8 shows a portable radio in which a microstrip plane antenna of the composite shared antenna shown in FIG. 7 is formed into a rod shape.
Figure 9:
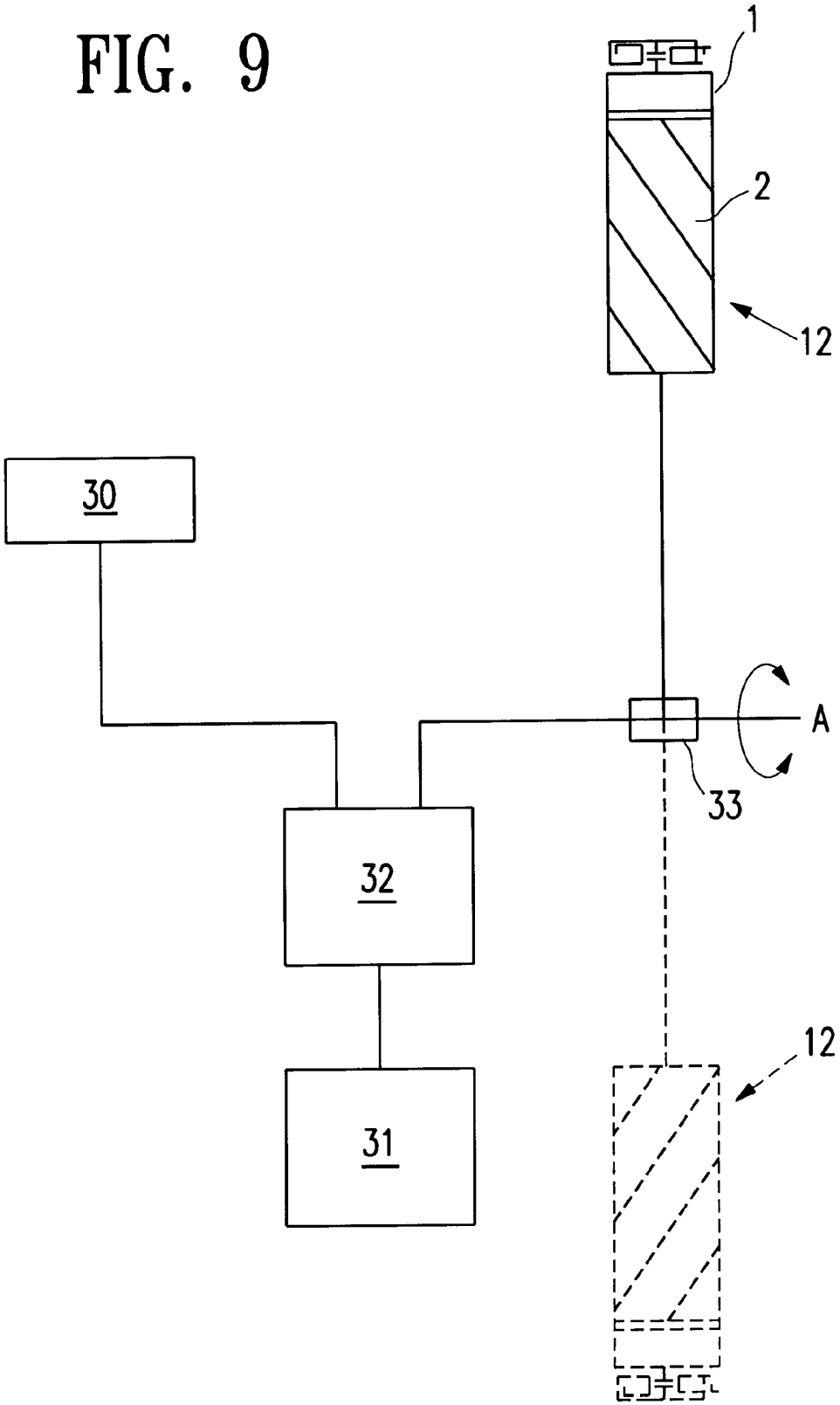
FIG. 9 is a block diagram showing a diversity antenna of the portable radio shown in FIG. 8.

FIG. 8 shows a portable radio (portable phone) equipped with the composite shared antenna 12 shown in FIG. 7 which has the rod-shaped MSA1. The composite shared antenna 12 is supported within the antenna holding cylinder 13 and is longitudinally spaced apart from the portable radio (portable phone) 11 by the length of the connection section 13*a*. Reference numeral 11*a* is a receiver, 11*b* a display, 11*c* an operation section, and 11*d* a transmitter. Reference numeral 30 is another microstrip plane antenna (MSA) provided on the upper surface of the portable radio 11. A diversity antenna is formed from the composite shared antenna 12 and the MSA 30 in combination. FIG. 9 is a block diagram showing the configuration of the diversity antenna. The diversity antenna comprises the composite shared antenna 12, the MSA 30, a radio section 31, and signal composition means (or signal selection means) 32 including the composite shared antenna 12 and the MSA 30. In FIG. 8, the composite shared antenna 12 is retained by the antenna retaining cylinder 13 and is positioned in an elevated position spaced from the casing of the portable radio 11 by only the length of the connection section 13*a*, thereby preventing a gain loss of the radio at a low elevation angle which would otherwise caused by the head of the user during a call. A call is made while the composite antenna 12 is in an upright position as shown in FIG. 8, and communications is established by means of a given right-bank (or left-bank) circularly-polarized wave. When the radio 11 is in a wait state, the composite antenna 12 is rotated to and is brought into close contact with the side surface of the casing of the portable radio 11. A rotary connector 33 rotates the composite antenna 12 with regard to the casing of the portable radio 11. A dotted line shown in FIG. 9 indicates a collapsed state of the composite antenna 12 as a result of rotation. In the collapsed state, the composite shared antenna 12 is oriented in the direction opposite to the direction of the same when the radio 11 is used, so that the direction of rotation of the circularly-polarized wave becomes reversed. Accordingly, the sensitivity of the composite shared antenna 12 is considerably deteriorated, and the MSA 30 principally operates while the radio 11 is in a wait state.

Figures 10A, 10B:
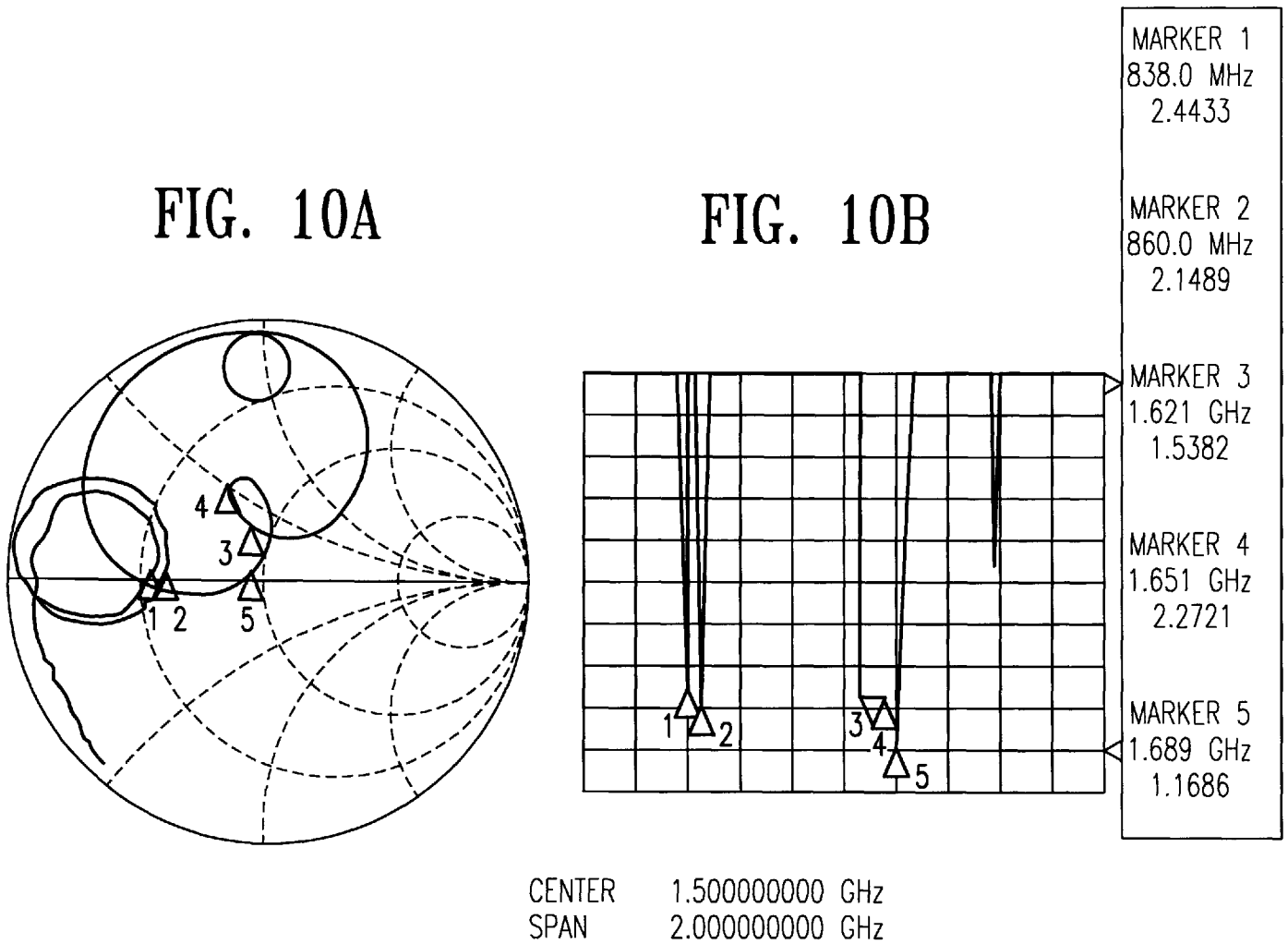
FIG. 10A is a Smith chart showing an example of measurement result obtained when the composite shared antenna, shown in FIG. 7, alone is used.
FIG. 10B is a chart showing the result of measurement of VSWR obtained when the composite shared antenna alone is used.
Figure 11A:
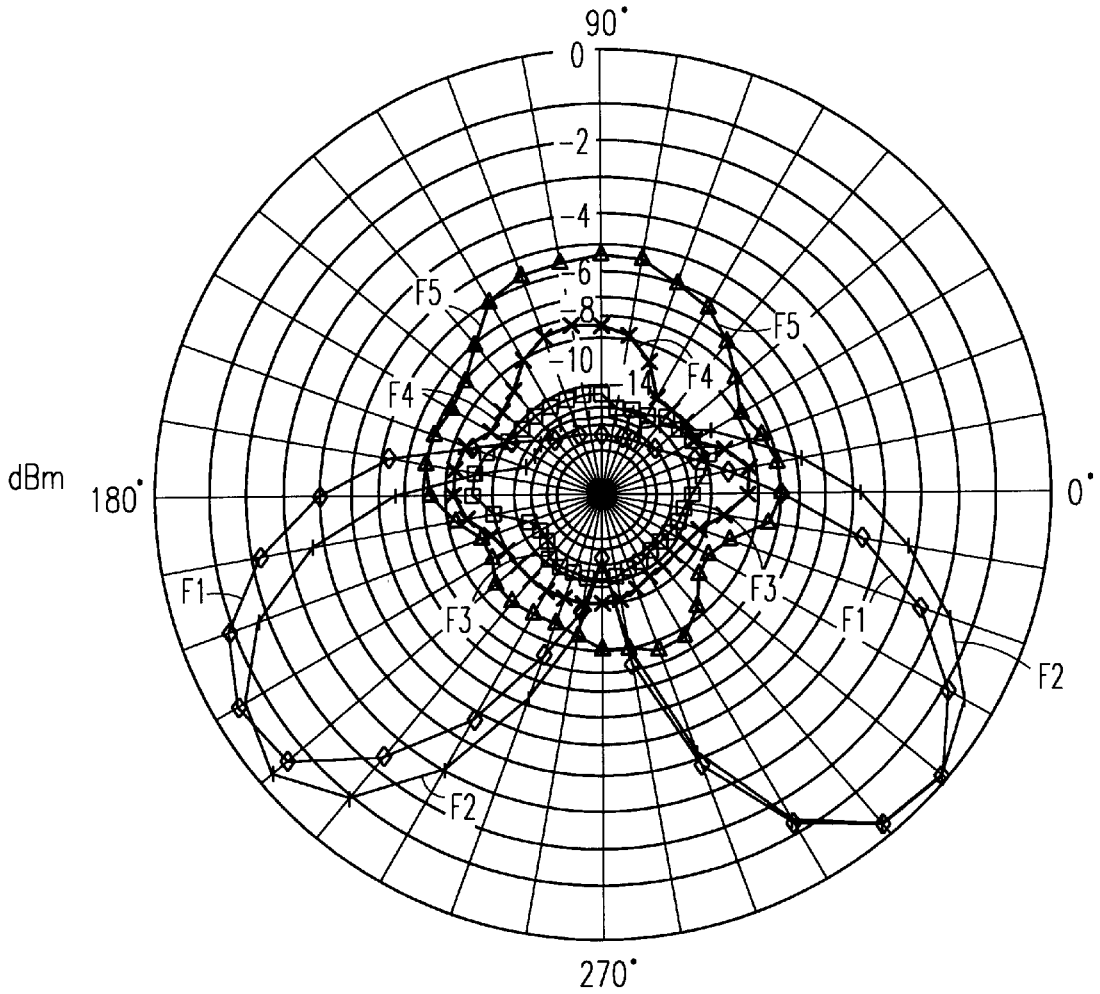
FIGS. 11A and 11B show an example of measurement of radiation patterns obtained when the composite shared antenna, shown in FIG. 7, alone is used at satellite communications frequencies and ground portable telephone frequencies, in that FIG. 11A shows a radiation pattern in which a direction of 0 degree corresponds to the direction of a lower left of the antenna shown in FIG. 7 and a direction of 180 degrees correspond to the direction of an upper right of the antenna shown in FIG. 7.
Figure 11B:
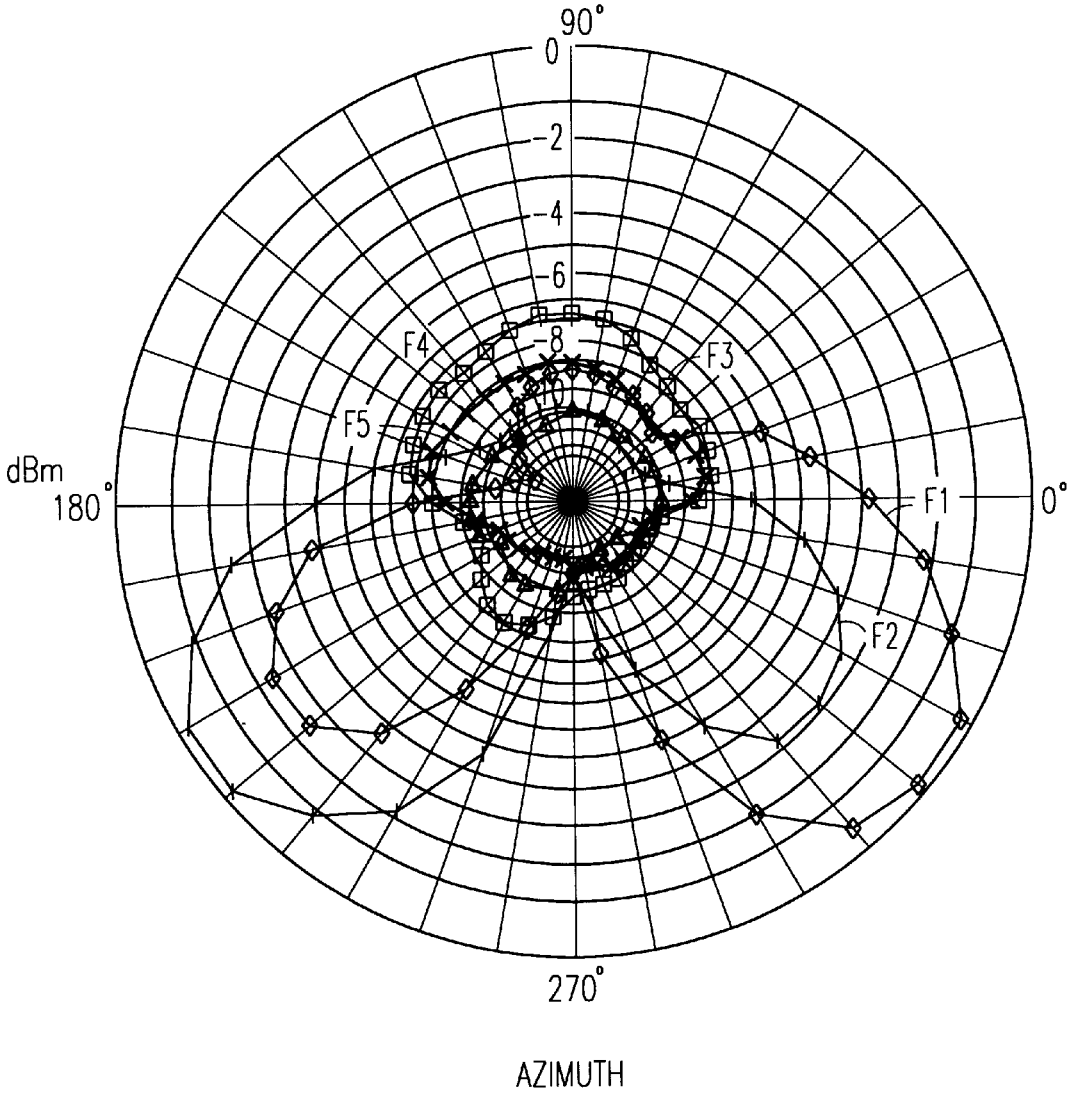

FIG. 10A is a Smith chart of the composite shared antenna 12 shown in FIG. 7. FIG. 10B shows an example of measurement of the VSWR of the antenna. FIG. 11 shows an example of the measurement of a radiation pattern of the composite shared antenna shown in FIG. 7.

As a result of the portable radio 11 being equipped with the shared antenna according to the present invention, it becomes easy to implement a compact device which enables satellite communications and ground communications through use of only one antenna. Although the foregoing description has been made with reference to the circularly-polarized antenna for use in a band of 1.6 GHz and the linearly-polarized antenna for use in a band of 800 MHz. The combination of the type of polarization and a frequency may be changed in accordance with the design of a desired system.

According to the second embodiment of the present invention, since there is no matching circuit, the matching of impedance of a circularly-polarized antenna and its gain, and the matching of impedance of a linearly-polarized antenna and its gain can be adjusted substantially independently of each other. Further, the radiation patterns of the circularly-polarized antenna at a low elevation angle and in the direction of the zenith and the radiation patterns of the linearly-polarized antenna in both the transmitted and received frequency bands do not substantially interfere with each other. Accordingly, an ideal shared antenna can be readily formed.

Third Embodiment

In third embodiment, in order to accomplish the foregoing object, a linearly-polarized antenna (or a linear antenna or a single-line helical antenna) is added to a feed point which feeds a high-frequency current and is positioned below a circularly-polarized antenna (a four-wire helical antenna) via capacitive elements. Such a configuration permits the circularly-polarized antenna and the linearly-polarized antenna to be fed through use of one feed line (a coaxial line). If a portable telephone is equipped with such an antenna, it becomes possible to make an access to a plurality of radio communications networks without the need of mechanical switching operation.

The shared antenna according to third embodiment of the present invention, as shown in FIG. 12, mainly comprises a circularly-polarized antenna (or a four-wire helical antenna) 11, a common feed point 1, a linearly-polarized antenna (or a single-wire helical antenna) 21, a first capacitive element 2, and a second capacitive element 3. The linearly-polarized antenna 21 may be a linear antenna.

First, the circularly-polarized antenna 11 comprises a cylindrical support 12 around which two lead wires "a" are wrapped through 180 degrees. These lead wires "a" are electrically connected together at an intersection 13 at the upper end of the cylindrical support 12 while an insulating substance (not shown) is interposed between the lead wires so as to prevent the lead wires from being d.c. coupled. The two lead wires "a" are electrically connected together at a wrap end 14 provided at the lower end of the support 12. Since the two lead wires "a" are separated from each other by means of the insulating substance at the intersection 13 at the upper end of the support 12, these wires are substantially different in length from each other. This signifies that the lead wires resonate at two frequencies. Further, if the lead wires are excited while a gamma matching element "b" is interposed between them, multi-resonance arises at a desired frequency, as a result of which the lead wires operate as a circularly-polarized antenna.

In order to add the linearly-polarized antenna (a single-wire helical antenna) 21 to the circularly-polarized antenna 11 without affecting the operation of the circularly-polarized antenna 11, the linearly-polarized antenna 21 is electrically connected to the common feed point 1 via the second capacitive element 3. The linearly-polarized antenna 21 comprises a cylindrical support 22 around which a linear conductor "c" is wrapped. Provided that the circularly-polarized antenna 11 operates at a frequency band of 1.6 GHz (i.e., a frequency band assigned to satellite communications), and the linearly-polarized antenna 21 is a quarter wavelength ($\lambda/4$) antenna which operates a frequency band of 800 to 900 MHz (i.e., a frequency band assigned to ground portable telephone frequency), the linearly-polarized antenna 21 operates substantially as a half wavelength ($\lambda/2$) vertical dipole antenna. In short, the linearly-polarized antenna 21 has a function of operating as a half wavelength ($\lambda/2$) vertical dipole antenna as shown in FIG. 13.

Further, the linearly-polarized antenna 21 is positioned on the opposite side with reference to the direction of radiation of the circularly-polarized antenna 11, and hence the radiation pattern of the circularly-polarized wave can be prevented from being distorted.

A center conductor 34 of a coaxial line 31 is connected to the common feed point 1. Power is fed to the circularly-polarized antenna 11 from the feed point 1 by means of the gamma rectifying element "b" via the capacitive element 2. The lead wires "a" are connected to an external conductor 33 of the coaxial line 31 by means of a coupling line 4. Power is fed to the linearly-polarized antenna 21 from the feed point 1 via the second capacitive element 3.

The foregoing antenna is attached to a portable radio, and transmission power is fed to the antenna from a radio circuit provided within the body of the radio to the feed point 1 by way of the coaxial line 31.

Figure 14:
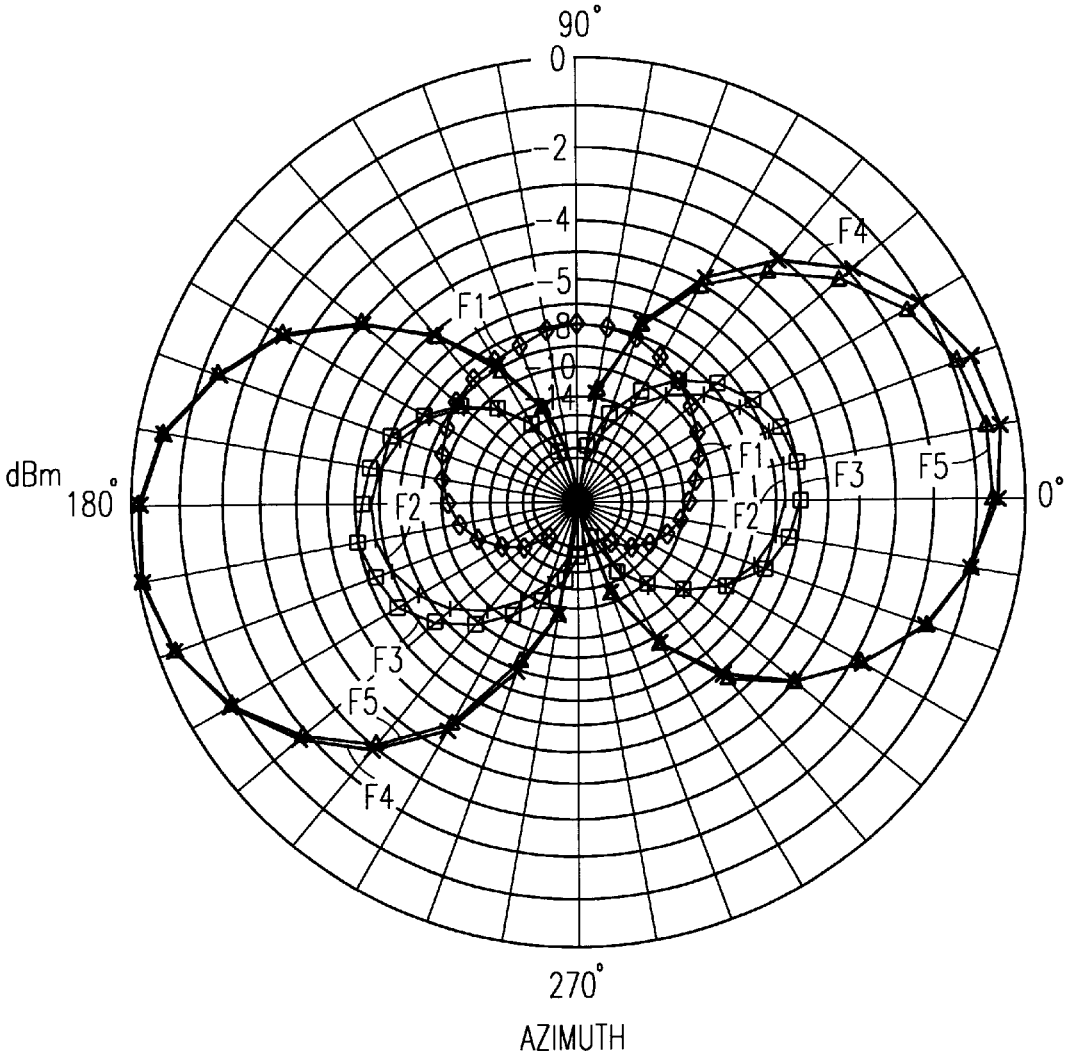
FIG. 14 shows an example of measurement of a radiation pattern obtained when the antenna shown in FIG. 12 is operated at a satellite communications frequency and a ground portable telephone frequency.

To experimentally check the operation of the antenna, a radiation pattern is measured through use of an antenna having a configuration pursuant to the configuration FIG. 12 (see FIG. 14).

The circularly-polarized antenna 11 (i.e., a four-wire helical antenna) 11 comprises a glass tube having a diameter of 15 mm and a length of 55 mm, and a copper line which has a width of 2 mm and is wrapped around the glass tube. The linearly-polarized antenna (i.e., a single helical antenna) 21 comprises a plastic cylinder having a diameter of 7 mm and a length of 17 mm, and a wire which has a diameter of 0.3 mm and is wrapped around the plastic cylinder five times. A ceramic capacitor (i.e., the second capacitive element 3) of several picofarads is interposed between the common feed point 1 and the linearly-polarized antenna 21.

According to the third embodiment of the present invention, a compact shared antenna which permits both satellite communications and ground communications can be realized, and a compact portable radio which permits both satellite communications and ground communications can also be realized. Further, power can be simultaneously fed to the shared antenna which operates in different polarized modes and at different frequencies, thereby preventing interference between the antennas. Further, the antenna does not require the need of mechanical switching action, thereby resulting in an improvement in the reliability of the antenna and the main body of the radio.

What is claimed is:

1. A shared antenna for use in a portable radio which includes a back-feed microstrip plane antenna operating at a first frequency, the microstrip antenna having a patch-shaped conductor provided on one surface of a plate-like dielectric substance, a ground conductor plate provided on the other surface of the dielectric substance, and at least one feed pin connected to the same surface, the improvement comprising:

a linear radiating element electrically connected to the upper end of the feed pin via a capacitive element; and wherein the microstrip plane antenna is a circularly-polarized antenna, and the linear radiating element is a linearly-polarized antenna.

2. A shared antenna for use in a portable radio which includes a back-feed microstrip plane antenna operating at a first frequency, the microstrip antenna having a patch-shaped conductor provided on one surface of a plate-like dielectric substance, a ground conductor plate provided on the other surface of the dielectric substance, and at least one feed pin connected to the same surface, the improvement comprising:

a linear radiating element electrically connected to the upper end of the feed pin via a capacitive element; and a helical antenna electrically connected to a lower surface of the ground conductor of the microstrip plane antenna constituting the shared antenna.

3. A shared antenna including a back-feed microstrip plane antenna which has a patch-shaped conductor provided on one surface of a plate-like dielectric substance, a ground conductor plate provided on the other surface of the dielectric substance, and at least one feed pin connected to the same surface the improvement comprising:

a crimped radiating element which has spatial expansion and is electrically connected to the vicinity of the upper end of the feed pin via a capacitive element; and wherein the microstrip plane antenna is a circularly-polarized antenna, and the crimped radiating element having spatial expansion is a linearly-polarized antenna.

4. A shared antenna including a back-feed microstrip plane antenna which has a patch-shaped conductor provided on one surface of a plate-like dielectric substance a ground conductor plate provided on the other surface of the dielectric substance and at least one feed pin connected to the same surface the improvement comprising:

a crimped radiating element which has spatial expansion and is electrically connected to the vicinity of the upper end of the feed pin via a capacitive element; and a helical antenna electrically connected to a lower surface of the ground conductor of the microstrip plane antenna which constitutes the shared antenna.

5. A shared antenna including a back-feed microstrip plane antenna which has a patch-shaped conductor provided on one surface of a plate-like dielectric substance, a ground conductor plate provided on the other surface of the dielectric substance and at least one feed pin connected to the same surface the improvement comprising:

a crimped radiating element which has spatial expansion and is electrically connected to the vicinity of the upper end of the feed pin via a capacitive element; and the crimped radiating element having spatial expansion comprises a first radiating element and a second radiating element; the microstrip plane antenna operates at a frequency f1; the first radiating element of the crimped radiating element operates at frequency f2; and the second radiating element of the crimped radiating element operates at frequency f3.

6. A portable radio using a shared antenna which includes a back-feed microstrip plane antenna, the microstrip plane antenna having a patch-shaped conductor provided on one surface of a plate-like dielectic substance, a ground conductor plate provided on the other surface of the dielectric substance, and at least one feed pin connected to the same surface, the improvement comprising:

a crimped radiating element which has spatial expansion and is electrically connected to the vicinity of the upper end of the feed pin via a capacitive element; and the microstrip plane antenna is a circularly-polarized antenna, and the crimped radiating element having spatial expansion is a linearly-polarized antenna.

7. A portable radio using a shared antenna which includes a back-feed microstrip plane antenna the microstrip plane antenna having a patch-shaped conductor provided on one surface of a plate-like dielectic substance a ground conductor plate provided on the other surface of the dielectric substance, and at least one feed pin connected to the same surface the improvement comprising:

a crimped radiating element which has spatial expansion and is electrically connected to the vicinity of the upper end of the feed pin via a capacitive element; and a helical antenna electrrically connected to a lower surface of the ground conductor of the microstrip plane antenna which constitutes the shared antenna.

8. A portable radio using a shared antenna which includes a back-feed microstrip plane antenna the microstrip plane antenna having a patch-shaped conductor provided on one surface of a plate-like dielectric substance a ground conductor plate provided on the other surface of the dielectric substance, and at least one feed pin connected to the same surface the improvement comprising:

a crimped radiating element which has spatial expansion and is electrically connected to the vicinity of the upper end of the feed pin via a capacitive element; and the crimped radiating element having spatial expansion comprises a first radiating element and a second radiating element; the microstrip plane antenna operates at a frequency f1; the first radiating element of the crimped radiating element operates at frequency f2; and the second radiating element of the crimped radiating element operates at frequency f3.

* * * * *